US005697311A

United States Patent [19]

Upmeier

[11] Patent Number: 5,697,311

[45] Date of Patent: Dec. 16, 1997

[54] AUTOMATIC SEWING MACHINE

[75] Inventor: Egon Upmeier, Lage, Germany

[73] Assignee: Durkopp Adler Aktiengesellschaft, Germany

[21] Appl. No.: 770,053

[22] Filed: Dec. 19, 1996

[30] Foreign Application Priority Data

Dec. 23, 1995 [DE] Germany ..... 19548559.9

[51] Int. Cl.[6] ..... D05B 21/00

[52] U.S. Cl. ..... 112/470.18

[58] Field of Search ..... 11/470.14, 470.18, 11/104, 113, 114, 470.06

[56] References Cited

U.S. PATENT DOCUMENTS 4,312,282 1/1982 Dorosz et al. .
4,602,578 7/1986 Yokoe et al. ..... 112/470.18
4,785,749 11/1988 Fischer .
4,793,272 12/1988 Scholl et al. .
4,809,627 3/1989 Upmeier et al. .
4,819,572 4/1989 Scholl et al. .
5,400,728 3/1995 Zinssmmeister ..... 112/470.18

*Primary Examiner*—Paul C. Lewis
*Attorney, Agent, or Firm*—Laff, Whitesel, Conte & Saret, Ltd.

[57] ABSTRACT

An automatic sewing machine comprises a stand, on which a workpiece guide and feed device is mounted. This device substantially comprises an x carriage, a y carriage displaceable thereon and a lever with a workpiece holder for the displacement of workpieces on a workpiece receiving plate. The y carriage is drivable by a drive stationary on the stand by way of a shaft which is likewise stationary on the stand and passes though the x carriage. A drive for the y carriage is supported on the shaft by means of a torque/linear bearing. Driving the shaft takes place in proximity to the sewing head and at a distance from an auxiliary station so that inaccuracies of guidance occasioned by torsion of the shaft are minimized during the sewing operation.

8 Claims, 4 Drawing Sheets

AUTOMATIC SEWING MACHINE

BACKGROUND OF THE INVENTION

1. Field of the Invention

The invention relates to an automatic sewing machine.

2. Background Art

U.S. Pat. No. 4,312,282 teaches an automatic sewing machine in which a cross slide is mounted on a stand, the x carriage of which is guided displaceably on the stand, while a y carriage is displaceable on the x carriage perpendicularly thereto on a horizontal plane. The y carriage is provided with a guide arrangement, by means of which at least one workpiece can be displaced for sewing on a workpiece-receiving plate and under the sewing head. The motor driving the x carriage is mounted on the stand. The motor driving the y carriage is likewise mounted on the stand. For the y carriage to be driven on the x carriage, a shaft that is coupled with the y drive is rotatably arranged on the stand and carries a rotatable pinion that lodges on it displaceably. This pinion meshes with a rack mounted on the y carriage and serves simultaneously for stabilizing the y carriage that is guided only on a single guide. Displacement of the x carriage that is likewise guided only on a single guide and of the y carriage is to take place on the sewing plane only formed by the workpiece receiving plate. The shaft is suspended and extends only over a comparatively short guide length, on which the workpiece is guided for sewing under the sewing head. This known design has the advantage that the cross slide exhibits little mass, since the motors that serve for driving are stationary on the stand, i.e. they need not be moved together with the cross slide. However, this known design is not suitable to be used in automatic sewing machines in which the workpiece is not only guided under the sewing head, but moved over prolonged feed distances from an auxiliary station to the sewing head and vice versa. Automatic sewing machines of this type are known for instance from U.S. Pat. No. 4,809,627.

SUMMARY OF THE INVENTION

It is the object of the invention to embody an automatic sewing machine which exhibits motors stationary on the stand for driving a first and a second carriage, while ensuring the transport of a workpiece holder between the sewing head and an auxiliary station over a comparatively long feed length.

According to the invention, this object is solved by an automatic sewing machine comprising the following features:

a stand, a workpiece receiving plate disposed on the stand, an auxiliary station, which is allocated to the workpiece receiving plate and serves for handling at least one workpiece, a sewing head comprising an upper arm disposed above the workpiece receiving plate and a base plate allocated to the workpiece receiving plate, a guide and feed device, comprising a first carriage supported on the stand to be straightly displaceable in a first direction that is parallel to the workpiece receiving plate, comprising a second carriage guided on the first carriage to be straightly displaceable in a second direction that is perpendicular to the first direction and parallel to the workpiece receiving plate, comprising a workpiece holder supported on the second carriage, comprising a first drive for displacement of the first carriage on the stand in the first direction, comprising a first motor stationary in relation to the stand, and a first drive transmission device coupled with the first motor and the first carriage, comprising a second drive for displacement of the second carriage on the first carriage in the second direction, comprising a second motor stationary in relation to the stand, comprising a shaft (44) which is stationary in relation to the stand and extends in the first direction, and which has a first end and a second end, the second end being in closer vicinity to the auxiliary station than the first end, comprising a first bearing which is stationary in relation to the stand and adjacent to the sewing head, and which rotatably lodges the first end of the shaft, comprising a drive connection which is coupled with the second motor on the one hand and on the other hand with the shaft in vicinity to the latter's first end, comprising a torque/linear beating rotatably supported on the first carriage to be displaceable on the shaft in the first direction, but non-rotatable relative to the shaft, and comprising a second drive transmission device coupled with the torque/linear bearing and with the second carriage.

Since the shaft is driven in the proximity of the sewing head, only a very short section of the shaft is exposed to torque during sewing when the first carriage is in vicinity to the sewing head, guiding the workpiece holder with the workpiece under the sewing head. Consequently, the accuracy of guidance of the workpiece holder in the second direction is very high. When the workpiece holder is situated at the auxiliary station the section subject to torque of the shaft is comparatively long, which is, however, no drawback. When the workpiece holder is moved at the auxiliary station, no substantial motions of the dynamic type occur in the second direction so that any tolerances regarding the positioning of the workpiece holder in the second direction keep within very close limits. When the at least one workpiece is sewn, only a comparatively short length of the shaft is strained by torque so that, referred to a desired position, any undesired deviation of position of the workpiece holder relative to the needle of the sewing head is minimized, which deviation may occur as a result of elastic torsion of the shaft.

Advantageous embodiments of the invention involve the arrangement, positioning and length of the shaft.

The arrangement of the guide of the first carriage underneath the workpiece receiving plate permits a compact structure with small components of little mass.

Further features, advantages and details of the invention will become apparent from the ensuing description of an exemplary embodiment, taken in conjunction with the drawing.

DESCRIPTION OF THE PREFERRED EMBODIMENT

Figure 1:
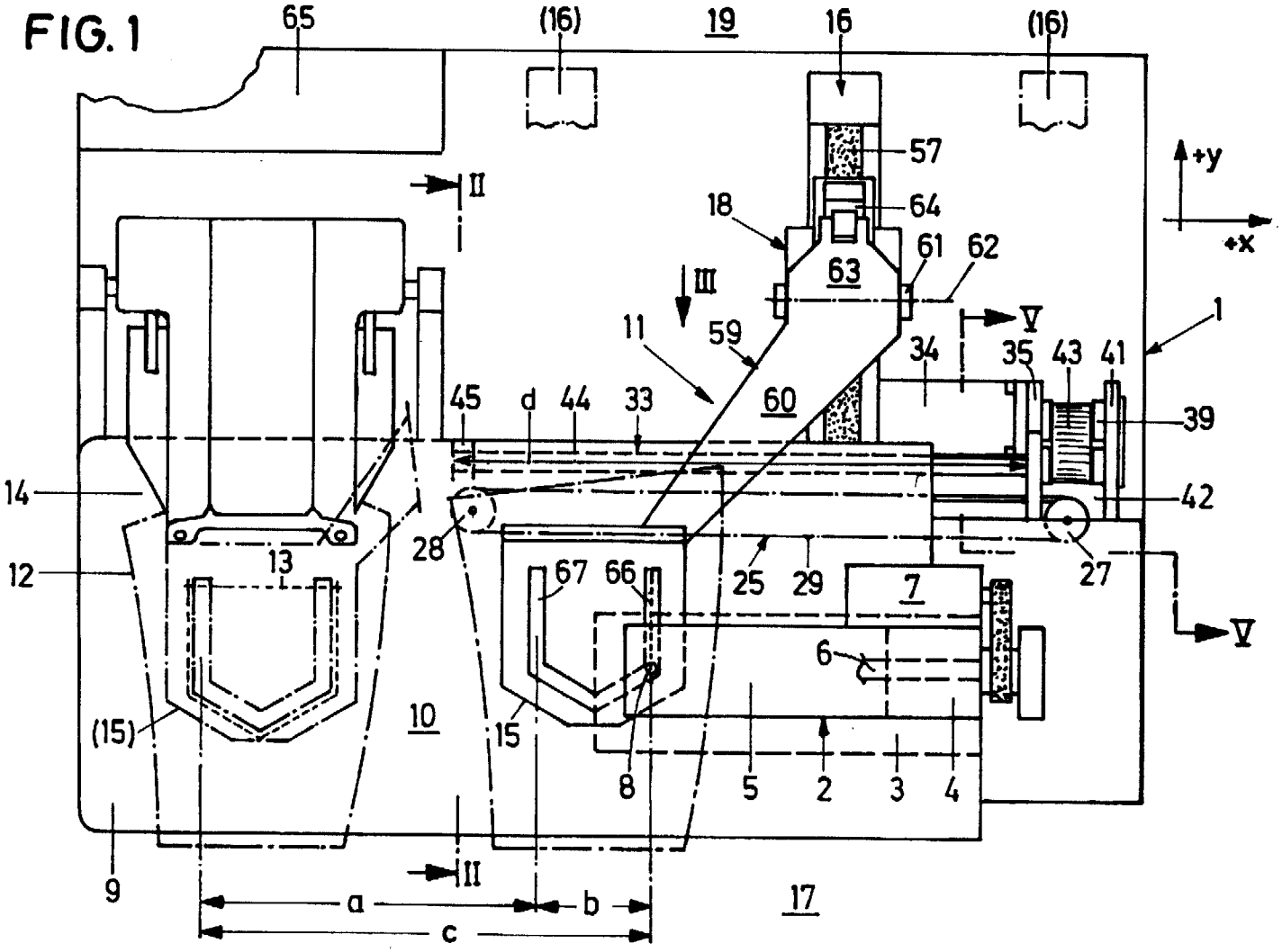
FIG. 1 is a plan view of an automatic sewing machine.

The automatic sewing machine of the drawing comprises a stand 1, on which a sewing head 2 is disposed stationarily. Customarily, it comprises a base plate 3, a standard 4 and an upper arm 5. As is usual, an arm shaft 6 to be driven by an electric sewing machine drive motor 7 is lodged in the arm 5 of the sewing head 2. Conventionally, the drive of a needle bar with a needle 8 and of a hook located in the base plate 3 derives from the arm shaft 6.

A workpiece receiving plate 9 is disposed on the stand 1, its upper side defining a sewing plane 10. This workpiece receiving plate 9 is disposed above the base plate 3 and has a stitch hole that permitts the needle 8 to pass through to the hook. Designs of this type are familiar and general practice.

A guide and feed device 11 is mounted on the stand 1, by means of which workpieces 12, 13 are fed from an auxiliary station, for instance a preparatory station 14, to the sewing head 2, where they are guided during the sewing job, subsequent to which they are conveyed to another auxiliary station (not shown), for instance a piler. In the embodiment shown, a pocket section that constitutes the second workpiece 13 is folded in the preparatory station 14 and positioned on a trouser cut that constitutes the first workpiece 12 and held by a workpiece holder 15 which is part of the device 11. Both workpieces 12, 13 are held by the workpiece holder 15 on the workpiece receiving plate 9 and displaced on the latter by means of the device 11. Numerous preparatory stations 14 of this type are known, for instance from U.S. Pat. Nos. 4,819,572, 4,793,272, and 4,785,749.

The guide and feed device 11 comprises an x carriage 16 which moves on the horizontal line in the x direction, i.e. from the preparatory station 14 to the sewing head 2 and at least partially back again, consequently from the left to the right and from the right to the left—referred to viewing direction from the operator's side 17. A y carriage 18 is disposed on the x carriage 16, moving on the horizontal line in the y direction, i.e. from the operator's side 17 in the direction to the back 19 of the automatic sewing machine and vice versa.

Figure 2:
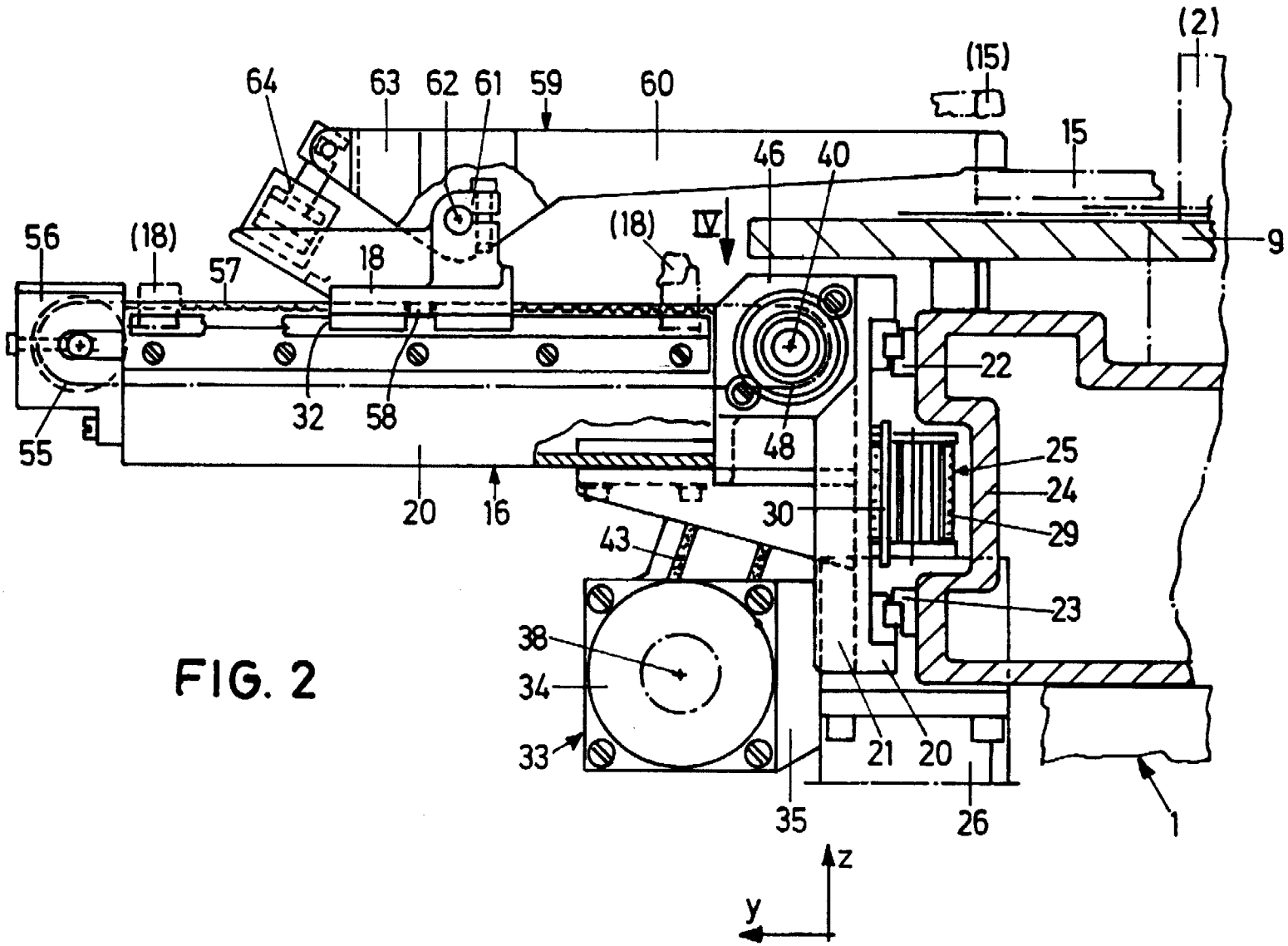
FIG. 2 is a vertical cross-section through the automatic sewing machine corresponding to the section line II—II of FIG. 1.

As seen in particular in FIG. 2—the x carriage 16 is angular and comprises a bearing arm 20 which extends horizontally in the y direction and a support arm 21 which extends vertically downwards from the latter, i.e. in the z direction. The z direction corresponds to the direction of motion of the needle 8 of the sewing head 2. The support arm 21 of the x carriage 16 is supported on the stand 1 by way of an upper guide 22 and a lower guide 23. Guides of this type are generally known, for instance from Japanese patent 1 405 187, and they are commercial, for instance under the designation THK LM SYSTEM of THK CO., LTD. of Tokyo, Japan.

Figure 3:
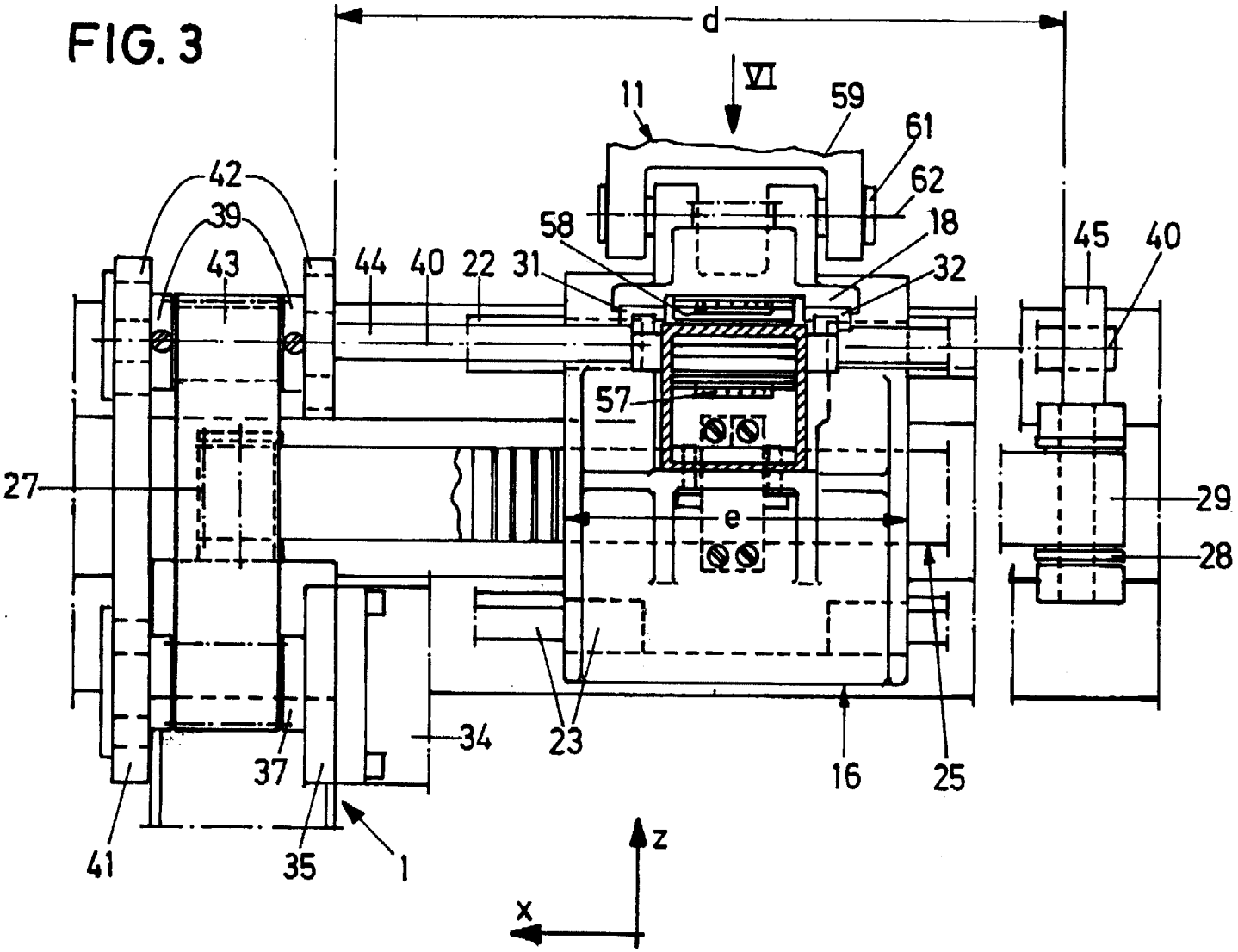
FIG. 3 is a partial rear view of the automatic sewing machine corresponding to the arrow III of FIG. 1.

Between the two guides 22, 23, which are supported on a part of the stand 1 formed as a pillow block 24, an x drive 25 engages with the support arm 21 of the x carriage 16. It has an electric motor 26, which is mounted on the stand 1 underneath the pillow block 24 and which chives a timing belt pinion 27 lodged in the stand, as seen in particular in FIGS. 2 and 3. In vicinity to the preparatory station 14, a deflection pulley 28 that is allocated to the timing belt pinion 27 is lodged in the stand 1. An endless timing belt 29 is fixed to the support arm 21 of the x carriage by fastening means 30 and guided around the pinion 27 and the deflection pulley 28. This x drive 25 serves to displace the x carriage 16 in the x direction between two end positions that are roughly outlined by dot-dashed lines in FIG. 1.

Figure 4:
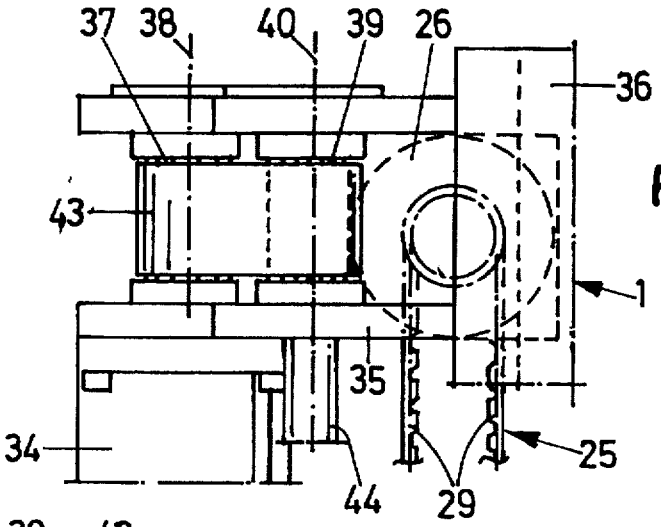
FIG. 4 is a partial plan view of the automatic sewing machine corresponding to the arrow IV of FIG. 2.
Figure 5:
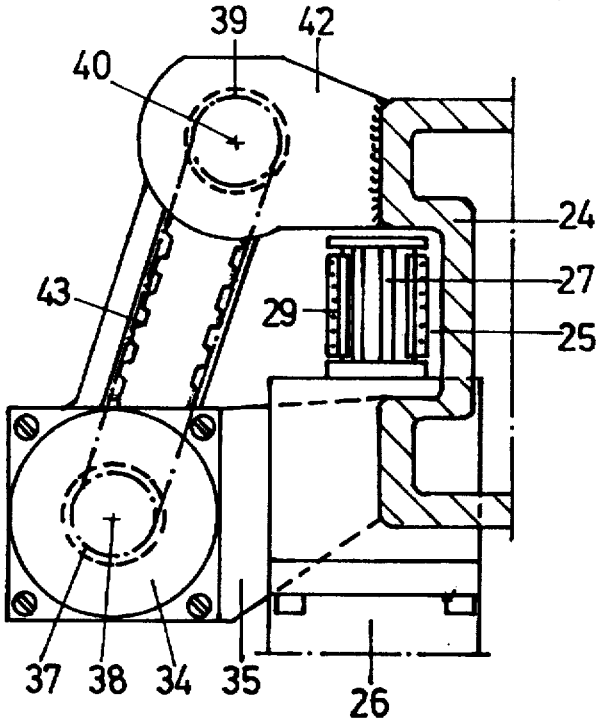
FIG. 5 is a vertical partial section through the automatic sewing machine corresponding to the section line V—V of FIG. 1.

The y carriage 18 is supported on the bearing arm 20, for instance in the form of a rectangular robe, of the x carriage 16 by way of two guides 31, 32 which, in the embodiment shown, are both on a common horizontal plane, i.e. an x-y plane, and extend in the y direction. A y drive 33 is provided for the y carriage 18 to be displaced on the x carriage 16. This drive 33 has an electric motor 34 which is fastened to a support 36 of the stand 1 by means of a support plate 35. A timing belt pinion 37, which has an axis of rotation 38 that extends in the x direction, is coupled with the motor 34. A timing belt pulley 39 is disposed in parallel thereto—as seen in particular in FIGS. 2, 3 and 4—and has an axis of rotation 40 that is parallel to the axis of rotation 38, i.e. it extends likewise in the x direction. The timing belt pinion 37 lodges in the support plate 35 and in a bearing plate 41 that is parallel thereto and mounted on the stand 1. The timing belt pulley 39 lodges rotatably in a pillow block 42, part of which is formed by the bearing plate 41. An endless timing belt 43, by means of which the motor 34 drives the timing belt pulley 39, is slung around the pinion 37 and the pulley 39. A shaft 44 likewise extending in the x direction is tightly united with the timing belt pulley 39, its axis of rotation being identical with the axis of rotation 40. This shaft 44 rims as far as into the proximity of the preparatory station 14, where it is supported in relation to the stand 1 by means of a bearing 45. As seen in particular in FIG. 2, the shaft 44 is disposed underneath the workpiece receiving plate 9.

Figure 6:
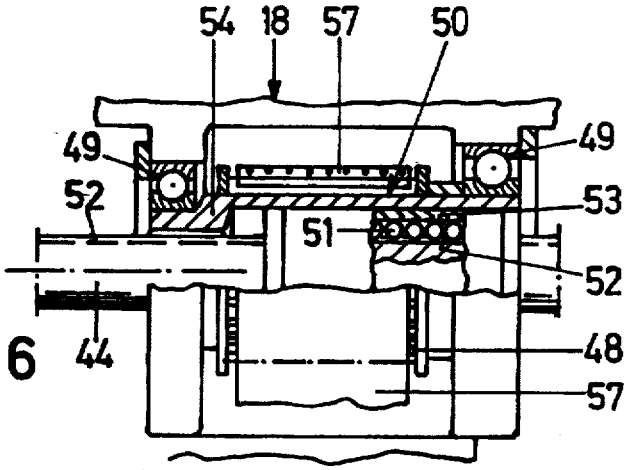
FIG. 6 is a partial plan view of the automatic sewing machine corresponding to the arrow VI of FIG. 3.

At the point of intersection of the bearing arm 20 and the support arm 21 of the y carriage 18, the latter is provided with a bearing and guide housing 46 that is passed through by the shaft 44. Concentrically of the shaft 44 and thus concentrically of the axis of rotation 40, a timing belt pulley 48 is supported freely rotatably by means of rolling beatings 49 in the housing 46, this timing belt pulley 48 again being non-rotatably joined to a torque/linear bearing 50. By way of balls 51, this torque/linear bearing 50 is joined to the shaft 44 to be non-rotatable, but displaceable in the x direction. These balls 51 engage with grooves 52 of the shaft 44 and with grooves 53 of a bearing bush 54 that encloses the shaft 44, as seen in detail in FIG. 6. This bearing bush 54 is non-rotatably connected with the timing belt pulley 48. So, the grooves 52, 53 extend also in the x direction. Torque/linear bearings 50 of this type are generally known and commercial.

In the vicinity of the free end of the x carriage 16, i.e. the end turned towards the back 19 of the automatic sewing machine, a deflection pulley 55 is lodged freely rotatably in a beating 56 that is connected with the x carriage 16. An endless timing belt 57, which is fastened to the y carriage 18 by fastening means 58, is slung around the timing belt pulley 48 and the deflection pulley 55 so that, as a result, the y carriage 18 can be displaced in the y direction by the electric motor 34 that is stationary on the stand. Consequently, the y drive 33 is formed by the motor 34, by the timing belt pinion 37, by the timing belt pulley 39 and the timing belt 43, by the shaft 44 which is driven by the timing belt pulley 39, by the torque/linear bearing 50 and the timing belt pulley 48 comprising the deflection pulley 55 and the timing belt 57.

The workpiece holder 15 is fixed to a double-armed, cranked lever 59, namely at the free end of the latter's cranked lever arm 60 of greater length. The lever 59 is arranged on the y carriage 18 in a pivot bearing 61 pivotably about a pivot axis 62 that extends in the x direction. The lever 59 has a—as compared with the lever arm 60—short lever arm 63, which extends in a direction towards the back 19 of the automatic sewing machine and with which engages a lift and press drive 64 that is supported on the y carriage 18. The lift and press drive 64 is a linear drive, i.e. a pneumatically actuated piston-cylinder drive.

The lever arm 60 extends in the y direction and is cranked in the direction towards the preparatory station 14. As seen in FIG. 2, it extends substantially horizontally and is disposed directly above the workpiece receiving plate 9.

Operation takes place as follows:

The first workpiece 12, in the present case the trouser cut, is placed on the workpiece receiving plate 9 under the preparatory station 14 which is formed as a folding device. Then the second workpiece 13, i.e. the pocket section, is folded in the preparatory station 14 and placed on the first workpiece 12. By the motors 26 and 34 being correspondingly triggered by a central computer control unit 65, the workpiece holder 15 is moved into a position shown by dot-dashed lines on the left of FIG. 1. By corresponding actuation of the lift and press drive 64 which is also triggered by the control unit 65, the workpiece holder 15, which had previously been in a position lifted off the workpiece receiving plate 9 and shown by dot-dashed lines in FIG. 2, is lowered onto the workpieces 12, 13 and pressed on the workpiece receiving plate 9. When all the the parts that are between the first workpiece 12 and the second workpiece 13 have been pulled out of the preparatory station 14, the workpiece holder 15 and the workpieces 12, 13 are moved on the workpiece receiving plate 9 substantially in the x direction into a position under the sewing head 2 shown in solid lines in FIG. 1. This feed motion again takes place by the motors 26 and 34 being correspondingly triggered. It reaches over a feed length a in the x direction.

By the sewing machine drive motor 7 of the sewing head 2 and the motors 26 and 34 being correspondingly triggered, a sewing job is then carried out, the workpiece holder 15 and the workpieces 12, 13 being guided under the needle 8 along the course of a seam 66 to be produced; this seam 66 is sewn through a corresponding recess 67 in the workpiece holder 15.

During this job, the workpiece holder 15 still covers a guide length b in the x direction, 5 b>a>2 b applying to the ratio of a relative to b. The maximum length of total motion c, to which applies c=a+b, corresponds to the length by which the x carriage can be displaced maximally in the x direction and consequently on the shaft 44. Between the bearing 45 and the pillow block 42, the shaft 44 must have a length d to which d=a+b+e applies, e being the maximum extension of the x carriage in the x direction in the vicinity of the guides 47 for the shaft 44. In practice, dimensions of d=1500 mm are conceivable. Referred to the x direction—the pillow block 42 with the timing belt pulley 39 is close to the sewing head 2 so that, during the entire sewing job, there is only a small distance of the timing belt pulley 48 and the torque/linear bearing 50 from the pillow block 42. Consequently, it is a minor portion of the shaft 44 that may be exposed to torque by reason of displacements of the workpiece holder 15 in the y direction during the sewing job. Correspondingly, errors in guidance of the workpiece holder 15 during the sewing job are negligible.

What is claimed is:

1. An automatic sewing machine comprising the following features:

a stand (1), a workpiece receiving plate (9) disposed on the stand (1), an auxiliary station (14) allocated to the workpiece receiving plate (9) for handling at least one workpiece (12, 13), a sewing head (2) comprising an upper arm (5) disposed above the workpiece receiving plate (9) and a base plate (3) allocated to the workpiece receiving plate (9), a guide and feed device (11), comprising a first carriage (16) supported on the stand (1) to be straightly displaceable in a first direction that is parallel to the workpiece receiving plate (9), comprising a second carriage (18) guided on the first carriage (16) to be straightly displaceable in a second direction that is perpendicular to the first direction and parallel to the workpiece receiving plate (9), comprising a workpiece holder (15) supported on the second carriage, comprising a first drive (25) for displacement of the first carriage (16) on the stand (1) in the first direction, comprising a first motor (26) stationary in relation to the stand (1), and a first drive transmission device coupled with the first motor (26) and the first carriage (16), comprising a second drive (33) for displacement of the second carriage (18) on the first carriage (16) in the second direction, comprising a second motor (34) stationary in relation to the stand (1), comprising a shaft (44) which is stationary in relation to the stand (1) and extends in the first direction, and which has a first end and a second end, the second end being in closer vicinity to the auxiliary station (14) than the first end, comprising a first bearing (42) which is stationary in relation to the stand (1) and adjacent to the sewing head (2), and which rotatably lodges the first end of the shaft (44), comprising a drive connection which is coupled with the second motor (34) on the one hand and on the other hand with the shaft (44) in vicinity to the first end of the shaft (44), comprising a torque/linear bearing (50) rotatably supported on the first carriage (16) to be displaceable on the shaft (44) in the first direction, but non-rotatable relative to the shaft, and comprising a second drive transmission device coupled with the torque/linear bearing (50) and with the second carriage (18).

2. An automatic sewing machine according to claim 1, wherein the second end of the shaft (44) is rotatably lodged in a second bearing (45).

3. An automatic sewing machine according to claim 1, wherein between the first bearing (42) and the second beating (45), the shaft (44) has such a length d that the first carriage (16) is displaceable between the auxiliary station (14) and the sewing head (2) in the first direction by a feed length a and a guide length b.

4. An automatic sewing machine according to claim 3, wherein 5 b>a>2 b applies to the ratio of the feed length a to the guide length b.

5. An automatic sewing machine according to claim 1, wherein the shaft (44) is disposed underneath the workpiece receiving plate (9).

6. An automatic sewing machine in particular according to claim 1, wherein the first carriage (16) is supported on the stand (1) to be displaceably guided on a plane which is substantially perpendicular to a plane spanned by the first direction and the second direction and parallel to the workpiece receiving plate (9).

7. An automatic sewing machine according to claim 6, wherein the first carriage (16) comprises a support arm (21) guided displaceably on the stand (1) and a bearing arm (20) therefrom extending in the second direction and on which the second carriage (18) is displaceably guided.

8. An automatic sewing machine according to claim 7, wherein the torque/linear bearing (50) is disposed in a portion where the support arm (21) and the bearing arm (20) meet.

* * * * *